United States Patent [19]

Bivins

[11] Patent Number: 4,980,938

[45] Date of Patent: Jan. 1, 1991

[54] PERINEAL BATHAID

[75] Inventor: Norman M. Bivins, Hazel Green, Ala.

[73] Assignees: John C. Garvin, Jr.; Harold W. Hilton, both of Huntsville, Ala. ; part interest to each

[21] Appl. No.: 379,593

[22] Filed: Jul. 14, 1989

[51] Int. Cl.[5] ..... A47C 20/02

[52] U.S. Cl. ..... 5/443; 5/431

[58] Field of Search ..... 5/80, 431, 443–445; 128/845, 882

[56] References Cited

U.S. PATENT DOCUMENTS

| | | | |
|---|---|---|---|
| 667,260 | 2/1901 | Stetson | 5/444 |
| 931,908 | 8/1909 | Weld | 5/444 |
| 1,151,874 | 8/1915 | Meinecke | 5/433 X |
| 3,512,189 | 5/1970 | Swanson | 128/845 X |

FOREIGN PATENT DOCUMENTS 103438 1/1917 United Kingdom .

*Primary Examiner*—Michael F. Trettel

*Attorney, Agent, or Firm*—John C. Garvin, Jr.; Harold W. Hilton

[57] ABSTRACT

A bathaid device for retaining the legs of a bed confined person in spreaded relation to permit access into the perineum of the person. The device includes an upper foot engaging portion disposed to receive the feet of the person thereon and leg means are provided for unsecured engagement with the foot board of the bed to retain the foot engaging portion in desired position. The device is made lightweight and portable.

6 Claims, 4 Drawing Sheets

PERINEAL BATHAID

TECHNICAL FIELD

This invention relates to a device for aiding in bathing an invalid person in bed and more particularly to a device which supports the legs of an invalid female in spreaded relation to permit bathing of the region of the body between the thighs (perineum) in a facile manner.

BACKGROUND OF THE INVENTION

To bathe a bed confined invalid person one must physically lift the invalid person and transport the invalid person to a bath tub, or as is done most of the time, the invalid person must be bathed while in bed. In the case where bathing in bed is necessary and the invalid person is a woman and has lost control of her legs, bathing of the area between the thighs is extremely difficult, since it is necessary to spread and retain the legs in spreaded relation while the area is bathed. This process generally requires two persons - one to hold the legs in spreaded relation and one person to bathe the perineum area.

Some prior art devices exist which attempt to provide a foot support for bed confined persons so that the person may be prevented from sliding down in the bed. Generally, these foot rest devices are cumbersome devices which are disposed for being clamped or otherwise secured to the foot of the bed. Such foot rests normally require tools and/or some mechanical expertise for attachment and removal from the bed. Additionally, the foot rests are designed to prevent a person from sliding down in the bed and are usable when the person's back has been elevated and the person tends to slide down in the bed. In order for the device to prevent such sliding, the confined person must have some use of his or her legs and must be capable of exerting a certain amount of leg pressure against the foot rest to prevent the sliding. Therefore, if a person has lost control of his or her legs such foot rests are useless for their intended purpose. U.S. Pat. Nos. 777,820, 931,908, 1,067,733, 1,365,750, 1,694,095, and 3,866,251 disclose several of such prior art devices for providing a foot support for a bed confined person.

It is an object of the present invention to provide a device for aiding in bathing the region of the body in the perineum area of a bed confined invalid person.

It is another object of the present invention to provide such a device which will support the legs of the invalid person in spreaded relation to permit access to the perineum area.

It is a further object of the present invention to provide such a device which will serve as an aid in bathing the bed confined person's perineum area.

It is still another object of the present invention to provide such a device which is portable and disposed for unsecured support on the bed of the invalid person.

DESCRIPTION OF THE PREFERRED EMBODIMENTS

Figure 1:
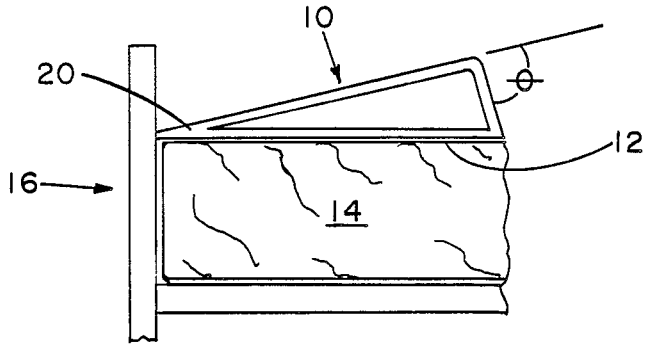
FIG. 1 is a pictorial view of one embodiment of bath aid device of the present invention shown positioned on a bed.

As seen in FIG. 1, a bathaid device 10 for invalid bed confined persons is shown positioned on the upper surface 12 of a mattress 14 of a bed 16. Device 10 includes a foot engaging portion 18 having a pair of leg portions 20 and 22 depending therefrom. As seen in FIGS. 2–7 the leg portions are formed on or secured (as by gluing) to sides 24 and 26 of foot engaging portion 18 and sides 28 and 30 of a downwardly depending body support portion 32 of the device 10. The legs serve as stiffeners to support body portion 32 on the upper surface of the bed. Though not absolutely necessary it is desirable that the forward upper surface 34 of foot engaging portion 18 and edges 24, 26, 28 and 30 of leg portions 20 and 22, respectively, be rounded so as not to present any sharp edges to the user. It is also desirable, although not required, that foot engaging portion 18 be inclined at a predetermined angle (as indicated by the angle $\Theta$ in FIG. 1) to the body portion 32 of the device.

Figure 2:
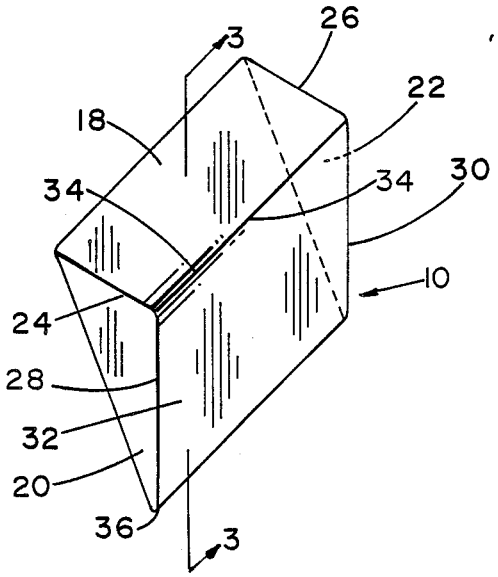
FIG. 2 is a pictorial view of one embodiment of the device of the present invention.
Figure 3:
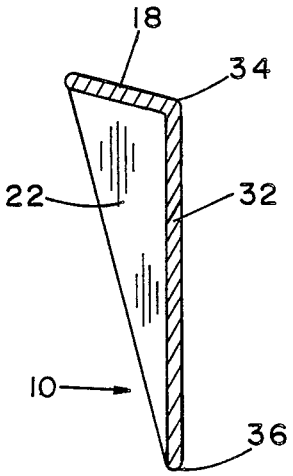
FIG. 3 is a sectional view taken along line 3—3 of FIG. 2.
Figure 4:
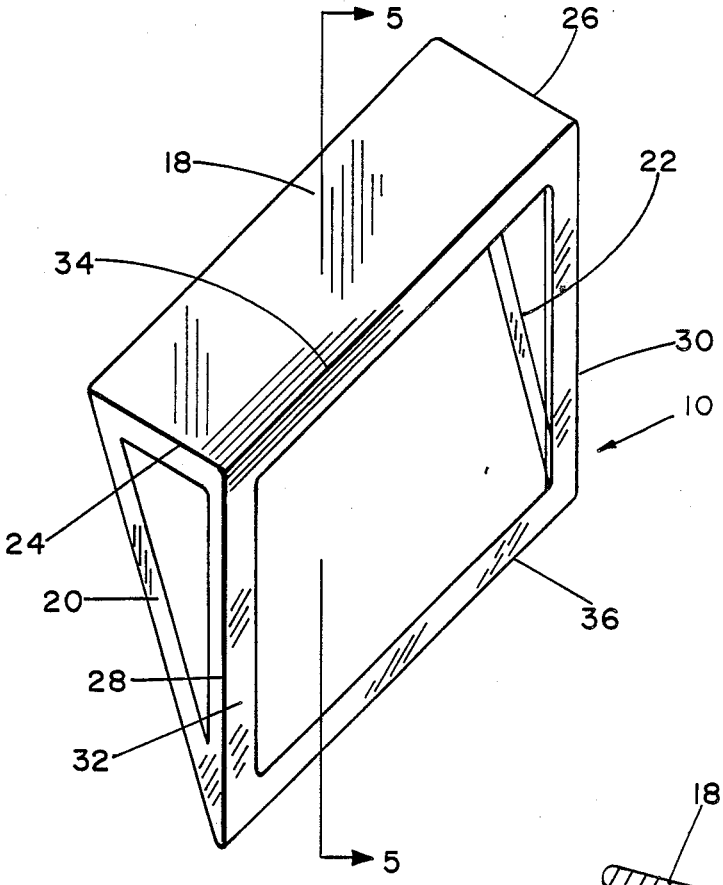
FIG. 4 is a pictorial view similar to FIG. 1 showing portions of the device removed to lighten the weight of the device to enhance the portability thereof.
Figure 5:
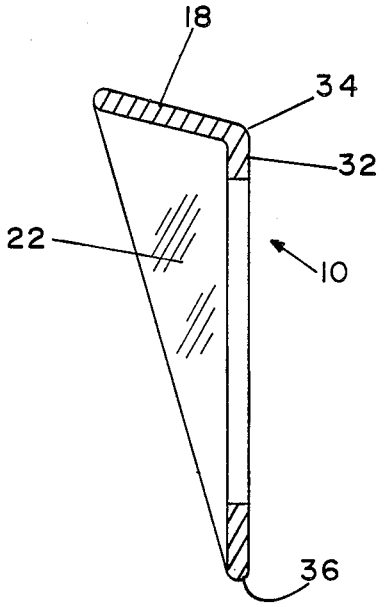
FIG. 5 is a sectional view taken along line 5—5 of FIG. 4.

FIGS. 4 and 5 illustrate the device of FIGS. 2 and 3 with portions of the downwardly depending leg portions 20 and 22 and body portion 32 removed to lighten the total weight of the device to enhance its portability. If desired, to add rigidity to the device, a lower portion 36 of downwardly depending body support portion 32 may be left after the majority of the body portion 32 has been removed. Lower portion 36 extends between leg portions 20 and 22 of the device to form a foot board engaging surface. The foot board is formed by a lower end frame member of the bed.

Figure 6:
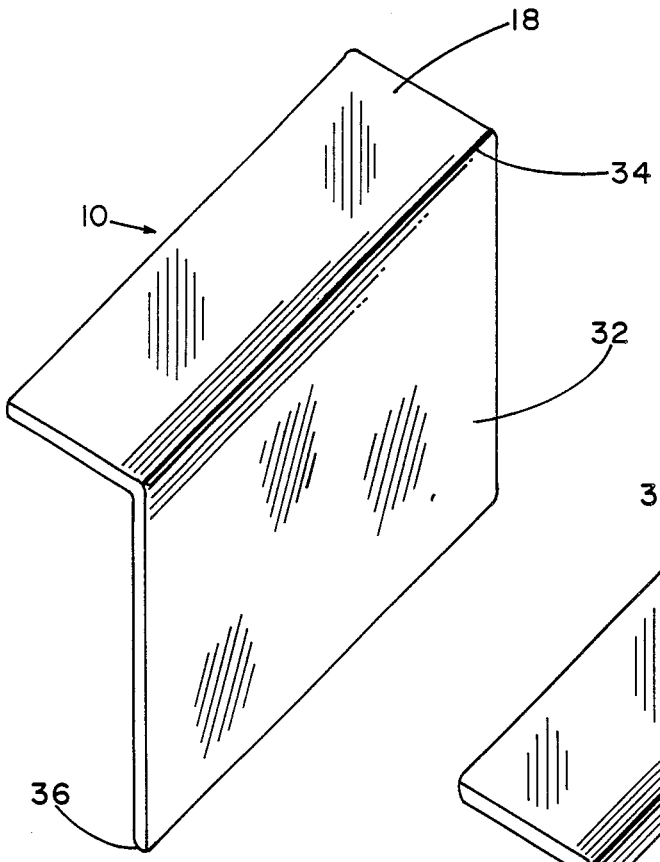
FIG. 6 is a pictorial view of another embodiment of the present invention.
Figure 7:
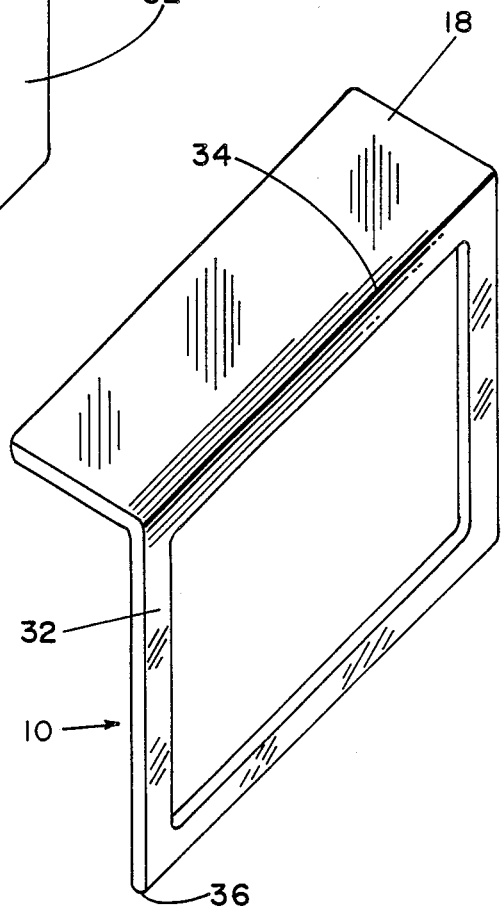
FIG. 7 is a pictorial view similar to FIG. 6 with portions of the device removed to lighten the device to enhance the portability thereof.

FIGS. 6 and 7 illustrate other embodiments of the present invention. As shown in FIG. 6, device 10 includes only the foot engaging surface or portion 18 and the downwardly depending body support portion 32 having the foot board engaging surface 36 thereon.

FIG. 7 is similar to FIG. 6 and illustrates the device 10 as including only the foot engaging surface or portion 18 and the downwardly depending body support portion 32 having the foot board engaging surface 36 thereon. The interior of body support portion 32 has been removed to lighten the weight of the device to enhance the portability thereof.

Figure 8:
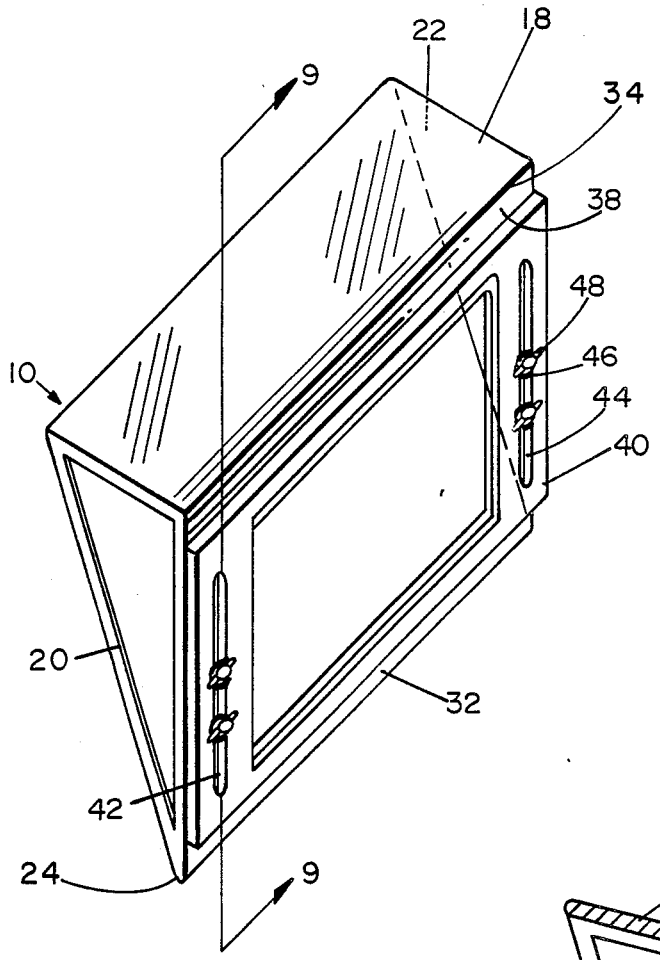
FIG. 8 is a pictorial view of another embodiment of the present invention wherein the length is adjustable.
Figure 9:
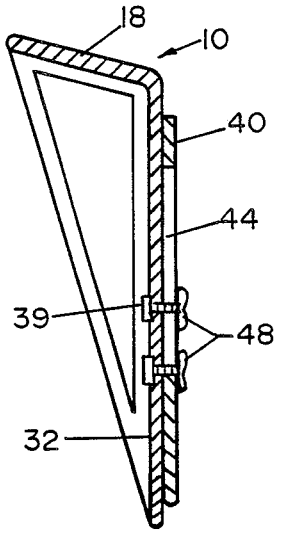
FIG. 9 is a sectional view taken along line 9—9 of the embodiment shown in FIG. 8.

FIGS. 8 and 9 illustrate a further embodiment of the present invention wherein the length of the device is adjustable. As seen in FIGS. 8 and 9, device 10 includes foot engaging portion 18 having a pair of leg portions 20 and 22 and support portion 32 depending therefrom in the manner set forth in the description of FIG. 1. However, in the present embodiment an adjustable member 40 is adjustably mounted to the forward surface 38 of support portion 32. To provide for the adjustability, a plurality of threaded studs 39 are secured to support portion 32 and extends therethrough. Studs 39 extend through a pair of elongated slots 42 and 44 in member 40. Washers 46 are placed around each threaded stud and wing nuts 48 are disposed for threaded relation on the studs to secure member 40 at the desired position on portion 32.

Figure 10:
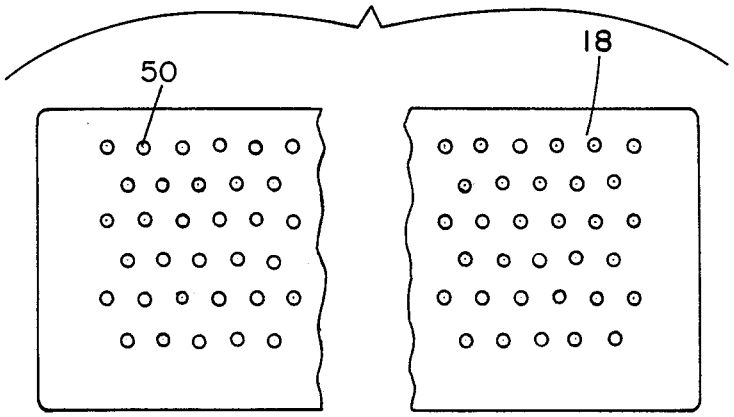
FIG. 10 is a top view of the foot engaging portion of the device having holes therein for lightening the device.

It is to be understood that predetermined portions of support member 40 and body support portion 32 may be removed to lighten the weight thereof and enhance the portability of the device. Additional lightening of all of the disclosed embodiments of the device may be accomplished as shown in FIG. 10, if desired, wherein foot rest surface or portion 18 is provided with a plurality of holes 50 therein.

It is to be understood that although the device of the present invention has been described as being used in conjunction with bathing a bed confined person's perineum area other uses may be resorted to that may require a portable, easily set up, device that is not attached to and does not require attachment to a bed frame. Some such uses may include pelvic examinations, which may be required when "stirrups" or "saddles" which are normally mounted to a bed or a portable frame, are not readily available. Another such use for the device of the present invention is as an aid for catherizing (drawing water from) a female with limited or no use of her lower extremities.

It is also to be understood that various other modifications of the present invention may be resorted to, such as providing legs on support 18 and making the legs telescoping so that the distance between the foot board of the bed and the foot engaging portion of the device may be varied. Additionally, other types of means may be resorted to in maintaining the legs of the device in folded or extended position; however, these and other modifications are to be taken within the spirit and scope of the appended claims.

I claim:

1. A bathaid device for aiding in the process of bathing a bed confined person's perineum comprising:

a foot engaging portion having an upper surface disposed for receiving the feet of the bed confined person thereon;

support means depending from said foot engaging portion for support thereof on said bed, said support means including a body portion having a lower edge surface, said body portion depending from said foot engaging portion and having a pair of side edges disposed in substantially normal relation with said lower edge surface, said lower edge surface disposed for unattached engagement with the foot board portion of the bed and disposed for supporting said foot engaging portion at a predetermined distance from said foot board, whereby said bed confined person's legs are spread apart responsive to resting thereof on said upper surface of said foot engaging portion to expose the person's perineum and permit unobstructed access thereto;

an adjustable member slidably mounted on said support means, said adjustable means including an adjustable member provided with a plurality of spaced elongated slots, and a plurality of threaded studs secured to said support means in extending relation through said slots, and fasteners disposed for threaded relation on said studs to retain said member in a desired position on said support means.

2. A bathaid device as set forth in claim 1 wherein said support means is defined by a pair of leg members each extending from said foot engaging portion adjacent said side edges thereof.

3. A bathaid device as set forth in claim 2 wherein said portions of said member are selectively cut-away to lighten the weight of the device.

4. A bathaid device for aiding in the process of bathing a bed confined person's perineum comprising;

a single member forming a foot engaging portion having an upper surface disposed for receiving the feet of said bed confined person thereon and a support means depending from said foot engaging portion for support thereof in a substantially upright position on the surface of the bed, said single member including a base portion for engaged relation with the footboard of said bed for retention of said bathaid device in a predetermined position on said bed, whereby said bed confined person's legs are spread apart responsive to resting thereof on said upper surface of said foot engaging portion to expose the person's perineum and permit unobstructed access thereto.

5. A bathaid device as set forth in claim 4 wherein said single member is provided with a pair of spaced sides, said bathaid device including a stiffener member disposed along each said spaced side, said stiffener members each provided with a lower bed surface engaging portion for resting on the upper surface of said bed to support said foot engaging portion thereon.

6. A bathaid device as set forth in claim 5 wherein portions of said member are selectively cut-away to lighten the weight of the device.

* * * * *